US005604507A

United States Patent [19]

Openlander

[11] Patent Number: 5,604,507

[45] Date of Patent: Feb. 18, 1997

[54] WIDE-BANDED MOBILE ANTENNA

[75] Inventor: Wayne R. Openlander, Chicago, Ill.

[73] Assignee: Antenex, Inc., Glendale, Ill.

[21] Appl. No.: 608,177

[22] Filed: Feb. 28, 1996

[51] Int. Cl.[6] ..... H01Q 1/50

[52] U.S. Cl. ..... 343/860; 343/715; 343/722

[58] Field of Search ..... 343/860, 722, 343/749, 850, 715, 906; H01Q 1/32, 1/00, 1/50

[56] References Cited

U.S. PATENT DOCUMENTS

| | | | |
|---|---|---|---|
| 3,264,647 | 8/1966 | Nuttle | 343/745 |
| 3,950,757 | 4/1976 | Blass | 343/791 |
| 4,028,704 | 6/1977 | Blass | 343/715 |
| 4,160,979 | 7/1979 | Drewett | 343/788 |
| 4,186,401 | 1/1980 | Altmayer | 343/715 |
| 4,445,122 | 4/1984 | Pues | 343/700 MS |
| 4,806,944 | 2/1989 | Jacomb-Hood | 343/777 |
| 4,835,539 | 5/1989 | Paschen | 343/700 MS |
| 5,111,213 | 5/1992 | Jahoda et al. | 343/722 |

OTHER PUBLICATIONS

Wheeler, Harold A.; "Fundamental Limitations of Small Antennas," *Proceedings of the IRE;* Dec. 1947; pp. 1479–1484.

Altshuler, Edward A.; "The Traveling-Wave Linear Antenna," *IRE Transactions on Antennas and Propagation;* Jul. 1961; pp. 324–329.

Wheeler, Harold A.; "The Wide-Band Matching Area for a Small Antenna," *IEEE Transactions on Antennas and Propagation,* vol. AP-31, No. 2; Mar. 1983; pp. 364–367.

Chu, L. J.; "Physical Limitations of Omni-Directional Antennas," *Journal of Applied Physics,* vol. 19; Dec. 1948; pp. 1163–1175.

*Primary Examiner*—Hoanganh T. Le

*Attorney, Agent, or Firm*—Cislo & Thomas

[57] ABSTRACT

A wide-banded mobile antenna enhancing signal transmission by broadening the effective transmission bandwidth. The wide-banded mobile antenna is interchangeable with currently existing mobile antennas as the two use connectors established by industry. An antenna matching network is situated within a protective housing having a metal shield. A toroidal inductor is serially connected with the antenna and creates a parasitic capacitance with the metal shield. The resulting network, including the antenna, is tuned. An antenna compensating network increases the bandwidth of the antenna with a parallel resonance network. The parallel resonance network has a capacitor and an inductor connected in parallel to the antenna and each other. The parallel resonance inductor is oriented so that the fields it generates are perpendicular to those of the antenna and the matching inductor to prevent coupling between the inductors. An optional series resonant network may enhance the compensating network with a capacitor and inductor connected in series to the antenna and each other. The fields of the series resonant inductor are perpendicular to those of the parallel resonance inductor.

31 Claims, 9 Drawing Sheets

EQUIVALENT CIRCUIT

CH1 RFL SWR 250 m / REF 1.5
1 1.9701
141.282 500 MHz
2 1.8289
147 .835 MHz
3 2.0172
153 .707 MHz
12 MHz
UVWR 2.0.1
3.0
Cor 2.5
2.0
UVWR
1.5
1.0
CH2 RFL I U FS
141MHz 143.5 146 148.5 151 153.5
1 90.93 Ω 22.246 Ω 25.06 nH
141.282 500 MHz

2: 27.856 Ω
5.7207 Ω
147.835 MHz
3: 92.488 Ω
-23.719 Ω
153.707 MHz
Cor
Del
MARKER 1
141.2825 MHz
SPAN 25.000 000 MHz
CENTER 146.000 000 MHz

WIDE-BANDED MOBILE ANTENNA

BACKGROUND OF THE INVENTION

1. Field of the Invention

This invention relates to transceiving signal antennas, and more particularly to a mobile antenna having a connected network allowing signal transmission over a broad band of frequencies.

2. Description of the Related Art

This invention relates to a certain type of mobile antenna, illustrated in FIG. 1, having: a threaded base mount connector C attached to a car or vehicle body, a housing H that mates to the threaded connector, and an antenna or collinear antenna rod A that fixes to the housing H often via a screw ferrule F or the like.

The base mount connector C allows antennas to be interchanged or replaced on the same common base. Variations on this system are widespread and supported by many manufacturers in the United States and other countries in a generally recognized industry standard.

The housing H usually holds an impedance matching network that, with the dimensions of the antenna A, sets the gain and operating frequency for the antenna system as a single unit. Matching networks include: "L" networks that are used to step the impedance up or down, simple inductors to resonate the capacitance of the antenna rod, or tapped inductors to accomplish both the inductive resonance and an impedance transformation.

The antennas attached to this housing fall into three general categories: antennas that are equal to or slightly shorter than ¼ wavelength long; antennas that are ½ wavelength long, or antiresonant, so they do not require a ground plane; and antennas that are ⅝ wavelength long. Antennas with multiple elements in series, which elements are phased to radiate to the broadside, will include an element in one of these categories to permit impedance matching.

Such antennas have a limited operating bandwidth and are not as useful as they might be. The bandwidth is limited by the small diameter and the electrical length of the antenna rod, and by the requirement for a matching network that uses a reactance to resonate with the antenna rod. The bandwidth is further narrowed when additional collinear elements are added to increase the gain of the antenna. These limitations and their consequences are described in such references as those by L. J. Chu, "Physical Limitations of Omni-Directional Antennas," Journal of Applied Physics, Volume 19, December 1948, pp. 1163–1175; and Harold A. Wheeler, "Fundamental Limitations of Small Antennas," Proceedings of the IRE, December 1947, pp. 1479–1484 and "Wideband Matching Area of a Small Antenna," IEEE Transactions on Antennas and Propagation, March 1983, pp. 364–367. In accordance with Maxwell's Laws relating to electromagnetism, the useful bandwidth of an omni-directional antenna is fixed by the size and gain of the antenna.

Modern radios with their broadband capacity and solid state circuits have operating capabilities far in excess of the limited bandwidth of such antennas. Generally, modern radios are limited by their connected antennas, restricting the efficiency of such radios. FCC bands are usually wider than the bandwidth of an efficient and gainworthy antenna, and when elements are added to an antenna to add desired gain, the antenna's bandwidth is narrowed. Consequently, otherwise available frequencies available for use in an established FCC band are beyond the capacity of modern radios using present antenna systems. Increasing the bandwidth of the associated antenna would allow modern radios to make use of more, if not the entire, available FCC frequency band.

A number of strategies have been developed to broaden the operating bandwidth of these mobile antennas. These strategies are illustrated in FIGS. 2 and 3 and in U.S. Pat. No. 3,950,757 entitled "Broadband Whip Antenna" issued to Blass on Apr. 13, 1976 and U.S. Pat. No. 4,028,704 entitled "Broadband Ferrite Transformer Fed Whip Antenna" issued to Blass on Jun. 7, 1977. The strategy outlined in these patents has the disadvantage of high VSWR (Voltage Standing Wave Ratio). Modern radios often will not tolerate a VSWR in excess of 2:1 at their output terminals and current industry standards steer installers away from such VSWR ratios.

Q Loading: Introducing a resistance R into either the rod or the matching network lowers the "Q" of the antenna system and increases the bandwidth. One popular approach is to replace the whip portion of the antenna by winding a resistive wire on a fiberglass core of small diameter. This is shown in U.S. Pat. No. 4,160,979, "Helical Radio Antennae."

Another commonly encountered approach is to use a resistive wire or a low "Q" capacitor in the matching network. Still another approach is to place a fixed resistor R into the antenna rod at the point of maximum current. This is described by Edward E. Altshuler, "The Traveling-Wave Linear Antenna," IRE Transactions on Antennas and Propagation, July 1961, pp. 324–329. Q Loading reduces the efficiency of an antenna by 50% or more.

Adding Diameter: Increasing the diameter of an antenna at a voltage node N increases its operating bandwidth. This is most easily done with a one-half wavelength (½ λ) antenna, which, because it is fed at a voltage node, the diameter of the antenna may be increased in the area of the feed point which places the increased mass close to the fixing point of the antenna assembly. Adding diameter in this fashion only marginally increases the bandwidth of an antenna.

Reactance Compensating Networks: The reactance change with frequency of an antenna network may be nearly cancelled over a band of frequencies by an appropriate compensating network I often using a parallel resonant network to compensate a series resonant antenna and a series resonant network to compensate a parallel resonant antenna.

The technique, including formulas and table for the development of such networks is described in *Microwave Filters, Impedance-Matching Networks, and Coupling Structures,* by George Matthaei et al., Artech house, Needham, Mass., 1980.

As described by Hugo Pues, U.S. Pat. No. 4,445,122, issued Apr. 24, 1984 entitled "Broad-Band Microstrip Antenna," the compensating network performs best if it is shielded from the associated antenna structure. This reduces coupling between the compensating network and the radiating field generated by the antenna. The current practice has been to place the network inside the automobile body (generally made of conducting metal), and further inside a metal shielding box. FIG. 3 shows such a box B1 adjacent the connector C where one manufacturer places the network in a box on the vehicle side of the base connector.

Another manufacturer places the network B2 in the coaxial cable a distance from the base connector C. This location, as described on page 43–28 of *Antenna Engineering Handbook,* 3d edition, edited by Richard C. Johnson, McGraw-Hill, Inc., is less than ideal for the requirements involved.

These approaches demonstrate the difficulty of locating the compensating network with the matching network inside the mounting housing. As a result they lack the interchangeable feature otherwise built into a connector-housing-antenna system. The advantage would be regained if the bandpass widening network were placed inside the mounting housing with the antenna matching network.

The difficulties in putting a bandpass filter into the coil housing derive from the following requirements and circumstances:

that the antenna be mismatched at its frequency of lowest VSWR because the available bandwidth increases as the mismatch is increased;

that the tuning of the network takes place when the antenna is attached because the reactive elements of the antenna matching network are partially shared with the bandwidth-expanding network;

the reactive elements of the bandwidth-widening, or compensating, network must be tuned to the same frequency and must be shielded from each other and from the antenna while simultaneously compensating for any effect of coupling to the shielding structure;

that the resonant networks have parasitic impedances which transform the coupled resistances in ways that cannot be accurately modelled on a computer;

that the network geometry be suitable for a wide variety of rod impedances; and that the impedance break of the connecter interface must be compensated by the bandwidth-widening network.

SUMMARY OF THE INVENTION

The present invention meets the foregoing requirements and provides a interchangeable wide-banded mobile antenna. The mobile antenna of the present invention comprises several elements, including:

1) A housing holding the bandwidth-compensating network that is constructed with a metal top cap and metal bottom ring. The cap and ring shield the inductors from the antenna field and are insulated from each other by a plastic cylinder or other insulation.

2) An antenna and matching network, affixed to the housing, having:

a1) Either a whip or rod antenna, less than ¼ wavelength, between ½ and ⅝ wavelength long, or the collinear equivalent or, a2) An antenna rod, less than ¼ wavelength long with resistance/inductance loading placed in the rod near the bottom and, b) A matching network made from a metal shield (such as the metal top cap) and a series inductance wound on a toroid core. The toroid inductor is oriented with its magnetic field parallel to the antenna's field and is shielded from the antenna's field by the metal shield. The shield also acts as a parallel capacitor to ground.

c) The antenna, shield, and inductor are tuned so the combined network, including any ground plane, yields an impedance whose real part is between 25 and 35 ohms over the intended bandwidth of the antenna and whose reactance is determined by the tuning of the compensating network as will be described.

3) A compensating network, consisting of:

a) a parallel resonance network, connected in shunt with the antenna matching network, whose inductor is oriented with its magnetic field perpendicular to the field of the antenna and the toroid inductor of the antenna matching network; and, optionally, b) a series resonant network added in series with the antenna matching and parallel resonance networks, whose inductive field is parallel to the field of the antenna, and shielded from the antenna by the bottom ring of the housing.

4a) The antenna, shield, and inductor are tuned for zero reactance at the center of the desired bandwidth and the compensating network is separately tuned to an approximate frequency one-half to one percent (½–1%) higher than the center frequency; or 4b) vice-versa, i.e., the antenna, shield, and inductor are tuned for zero reactance at an approximate frequency one-half to one percent (½–1%) higher than the center frequency and the compensating network is separately tuned to the center of the desired bandwidth.

By providing the matching and compensating networks, a broadbanded mobile antenna is achieved as interchangeable with antennas currently on the market and compatible with the now-existing connectors. Modern radios previously limited by antennas having narrower band capacities are freed from the frequency restrictions of such antennas by use of the present wide-banded mobile antenna. Clearer and better communications are thereby achieved, and radio communications are made more robust and stable.

OBJECTS OF THE INVENTION

It is an object of the present invention to provide a mobile antenna that has wide-banded capacities.

It is an object of the present invention to provide better radio communications by use of a broadbanded mobile antenna.

It is an object of the present invention to provide a wide-banded mobile antenna having an antenna matching network and a broadbanding compensating network that are as uncoupled as possible.

It is yet another object of the present invention to provide a wide-banded mobile antenna that is interchangeable with currently existing antennas and that is adapted to fit present mobile antenna connectors.

It is another object of the present invention to provide an interchangeable wide-banded mobile antenna that is self-contained, having both antenna matching and broadbanding compensating networks contained within the housing or otherwise intimately associated with the antenna.

These and other objects and advantages of the present invention will be apparent from a review of the following specification and accompanying drawings.

DESCRIPTION OF THE PREFERRED EMBODIMENT(S)

Figure 1:
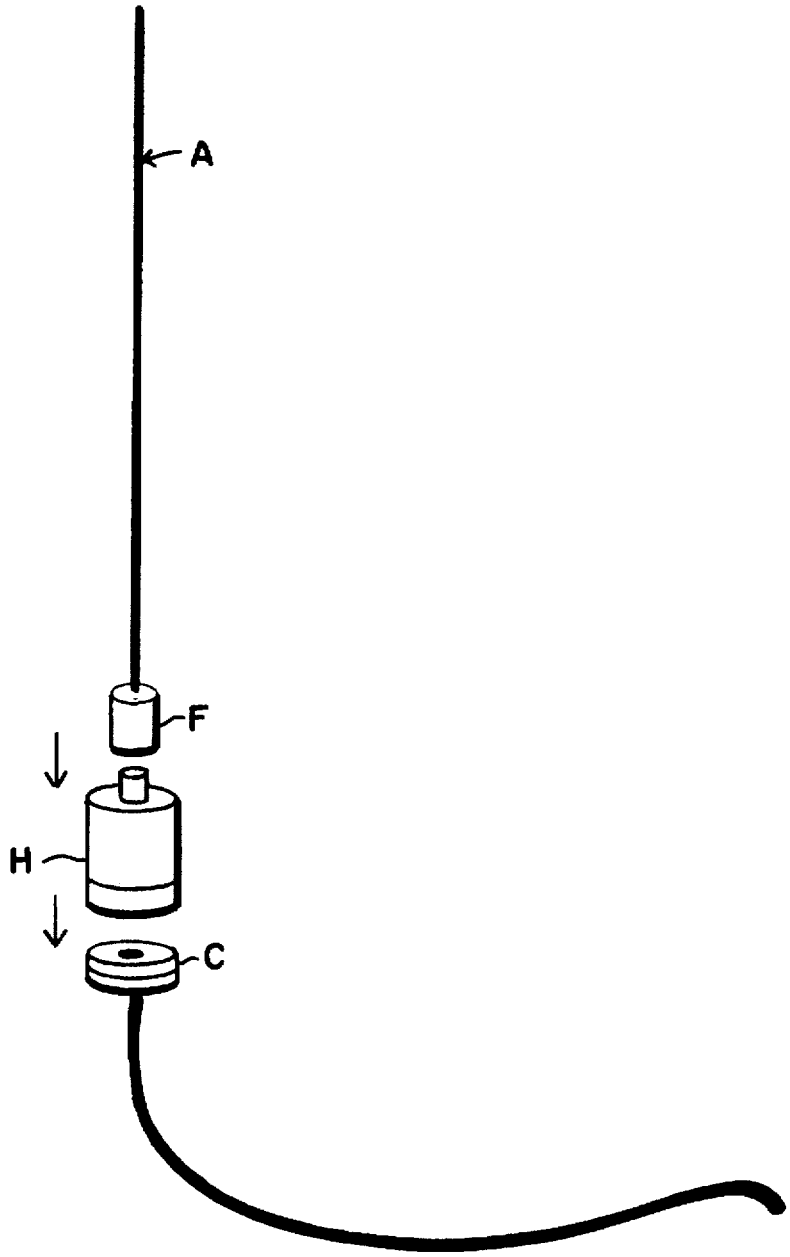
FIG. 1 PRIOR ART
FIG. 1 shows a side perspective view of an antenna previously known in the art.
Figure 2:
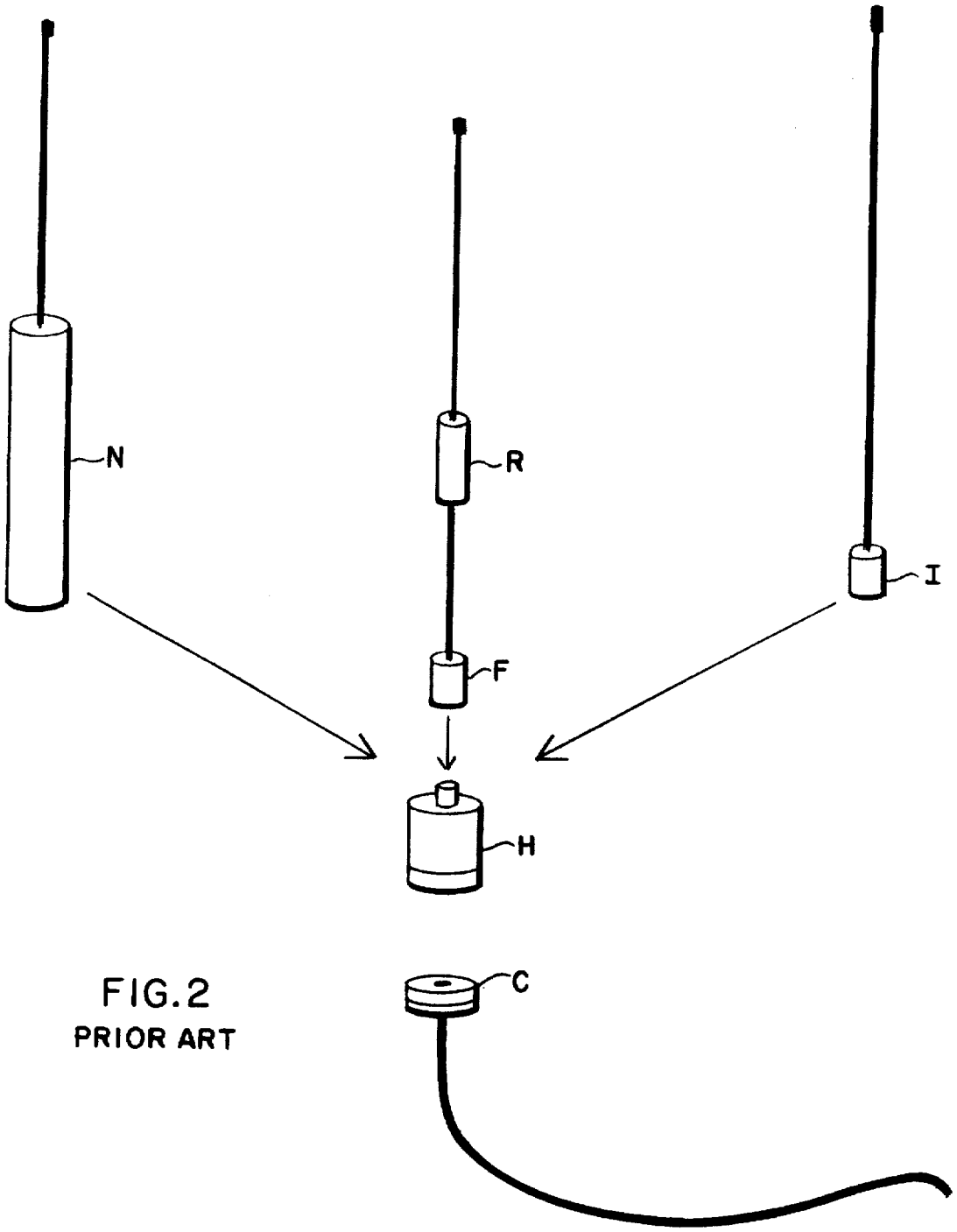
FIG. 2 PRIOR ART
FIG. 2 shows side perspective views of antennas previously known in the art.
Figure 3:
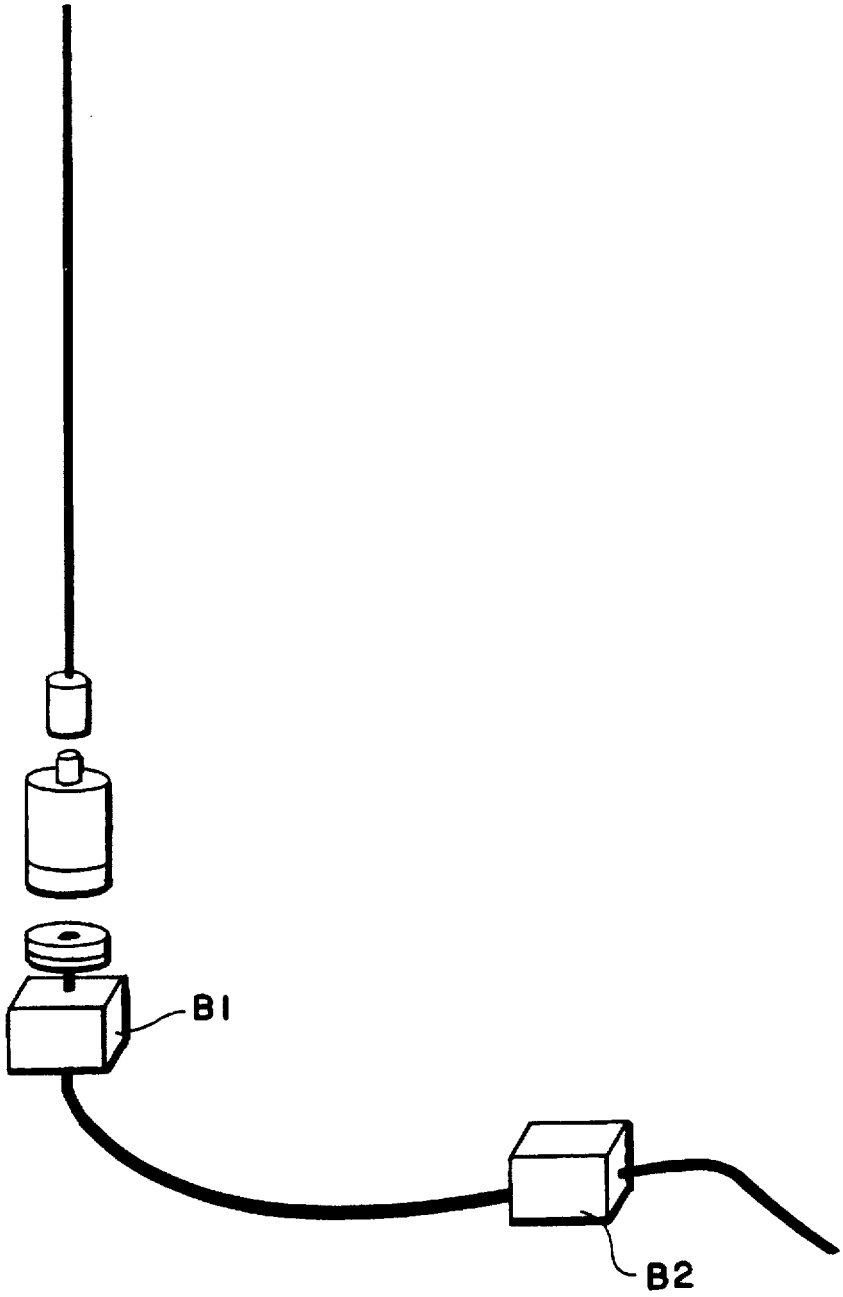
FIG. 3 PRIOR ART
FIG. 3 shows an antenna previously known in the art along with associated circuitry used in conjunction with the antenna.

FIGS. 1–3 show antennas previously known in the related art of the present invention and have been addressed in the background section, above. The present invention deals with the ability of a mobile antenna to be broadbanded so that a wider frequency regime is available for signal transmission.

Figure 4A:
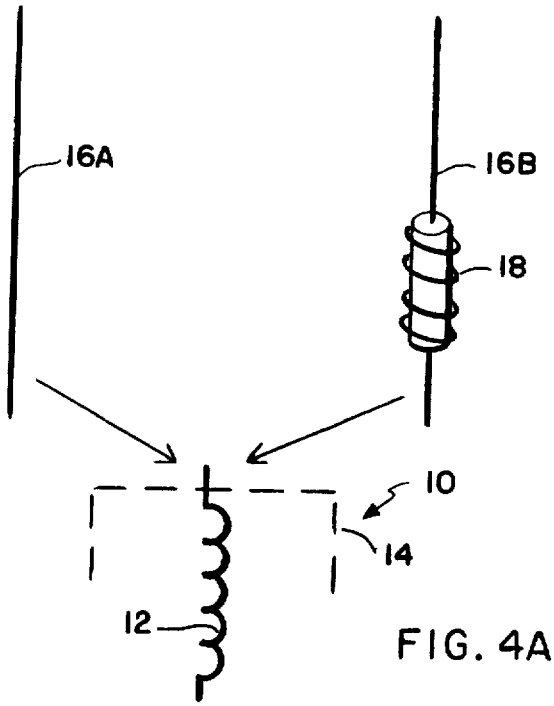
FIG. 4A shows a first embodiment of the present invention with an inductor providing a matching network to two possible antennas.

Referring now to FIG. 4A, an antenna matching network 10 has toroidally wound series inductor 12 shielded from the antenna by a metal shield, or hat, 14 that acts as a partial Faraday cage. The metal shield 14 isolates the toroidal inductor 12 of the matching network 10 from the adjacent electromagnetic fields generated by the antenna.

The top metal shield 14 provides some capacitance between itself and the ground so as to act as a capacitor connected in parallel to the antenna. Through the capacitance of the shield 14 and the inductance of the toroidal inductor 12, the matching network 10 is provided to the antenna so that the impedance of the antenna may be matched with that of the system delivering the transmission signal.

In FIG. 4A, two antennas are shown that may advantageously implement the matching network in the present invention. The first antenna **16*a* may be an antenna whip cut to less than one-quarter wavelength or cut to greater than one-half wavelength but less than five-eights wavelength. The second antenna 16*b* is an antenna whip cut to less than one-quarter wavelength and inductively loaded with a resistive wire 18** to meet the resistance requirement necessary when the antenna is connected to the base.

The antenna matching network 10 serves to provide impedance matching for the antenna **16*a*, 16*b*** and other antennas as set forth herein.

The magnetic field generated by the toroidal inductor 12 of the antenna matching network 10 is geometrically disposed so as to be parallel to the field generated by the associated antenna. The antenna 16, the metal shield 14 and the toroidal inductor 12 are tuned so that the combined network, including the ground plane, yields an impedance having a resistance between 25 and 35 ohms over the intended bandwidth of the antenna. The combined antenna network of the antenna 16, shield 14, and toroidal inductor 12 is also tuned so that the reactance of the impedance is zero (0) at frequencies one to two megahertz (1–2 MHz) higher than that of the centered frequency of the compensating network described in more detail below.

Figure 4B:
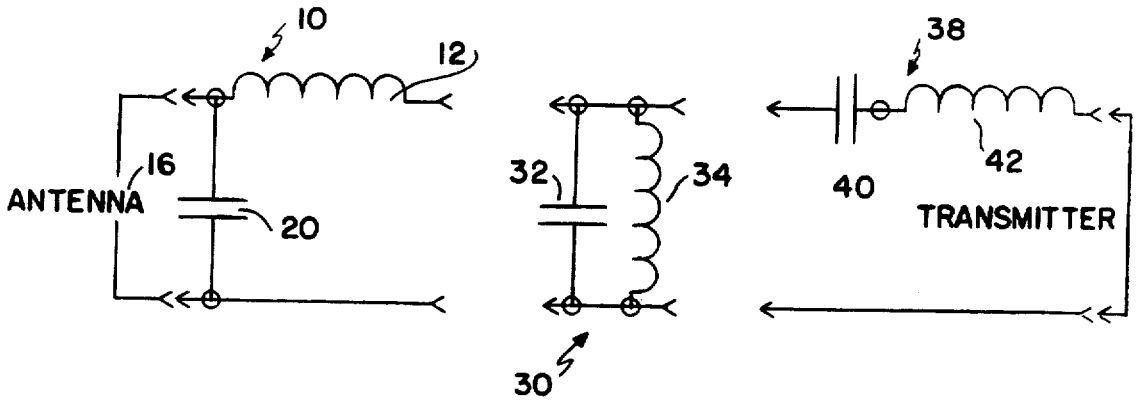
FIG. 4B shows an equivalent circuit for the antenna matching and broadbanding compensating networks of the present invention.

Referring now to FIG. 4B, the matching network 10 is shown as electrically adjacent to the antenna 16. The matching network 10 has a toroidal inductor 12 connected in a series with the antenna 16. A capacitor 20 is connected in parallel with the antenna 16. The capacitor 20 arises from the parasitic capacitance experienced between the shield 14 and ground.

Also shown in FIG. 4B is the band-broadening compensating network 30. The compensating network 30 provides both a capacitance and an inductance in parallel with the antenna 16. Coupled to the antenna matching network 10, the band-broadening compensating network 30 has a parallel capacitor 32 and a parallel inductor 34. Taken together, the parallel capacitor 32 and parallel inductor 34 may be considered a parallel resonance network connected in shunt with the antenna 16 and the matching network 10. The magnetic field of the parallel inductor 34 is oriented perpendicularly to the field of the antenna 16 and, therefore, perpendicularly to the field of the toroidal inductor 12 of the matching network 10, to prevent coupling between the toroidal inductor 12 and the inductor 34. This allows electromagnetic isolation between these two elements merely by their geometrical configuration and not by any specific shielding. This provides greater manufacturing conveniences and economies as well as requiring smaller space in the housing to accommodate the matching and compensating networks.

As an optional portion of the band-broadening compensating network 30, a series resonant network 38 can be included to provide better band broadening below fifty megahertz (50 MHz). The series resonant network 38 has a series resonant capacitor 40 connected in series with a series resonant inductor 42. The series resonant network 38 is connected in series with the toroidal inductor 12 of the antenna matching network 10. The inductor 42 may be a toroidally wound inductor along the lines of the toroidal inductor 12 of the antenna matching network 10. The series resonant elements may be protected by a metal ring or shield at the bottom of the housing which shields the series resonant inductor 42 from electromagnetic fields outside the bottom ring or shield. The capacitance delivered by the series resonant capacitor 40 arises from an actual capacitor in series with the toroidally wound series resonant inductor 42. The series resonant inductor 42 generates an electromagnetic field parallel to the toroidal inductor 12 of the antenna matching network 10 and perpendicular to the inductor 34 of the band-broadening compensating network 30. While the parallel geometry of the series resonant inductor 42 and the matching toroidal inductor 12 may serve to couple them, it serves to decouple them from the band-broadening compensating inductor 34.

Figure 5:
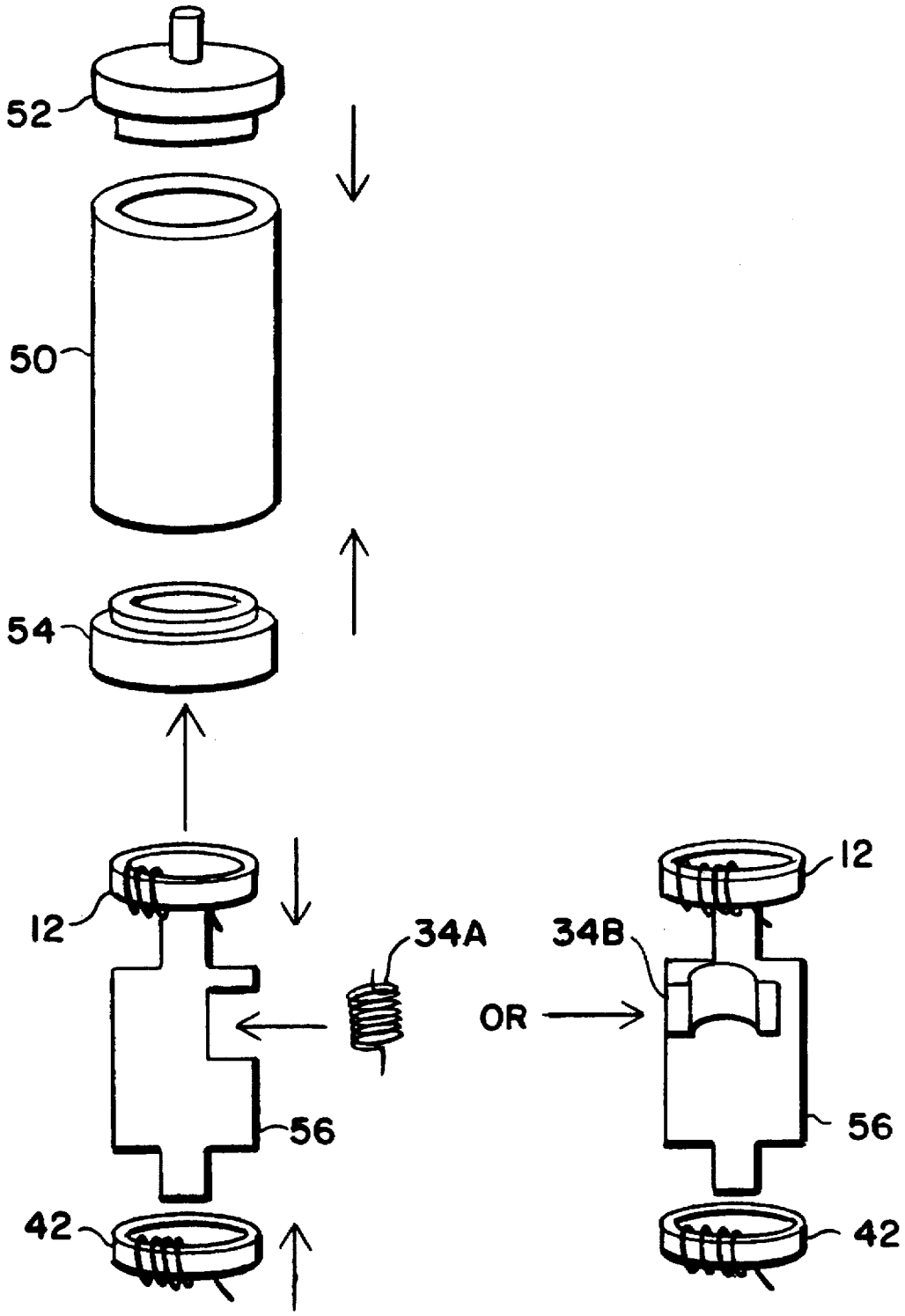
FIG. 5 shows an exploded view of the matching and compensating networks of the present invention with alternative embodiments shown for the inductor of the parallel resonant network.
Figure 6A:
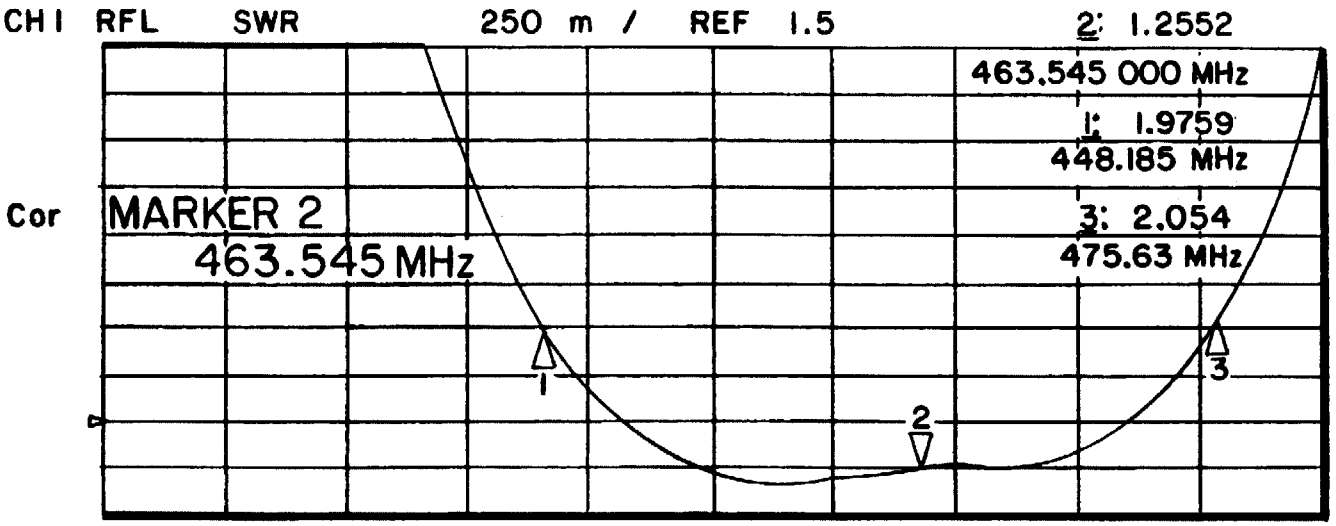
FIG. 6A shows a frequency response graph of an antenna constructed according to the present invention centered at approximately 463 MHz.
Figure 6B:
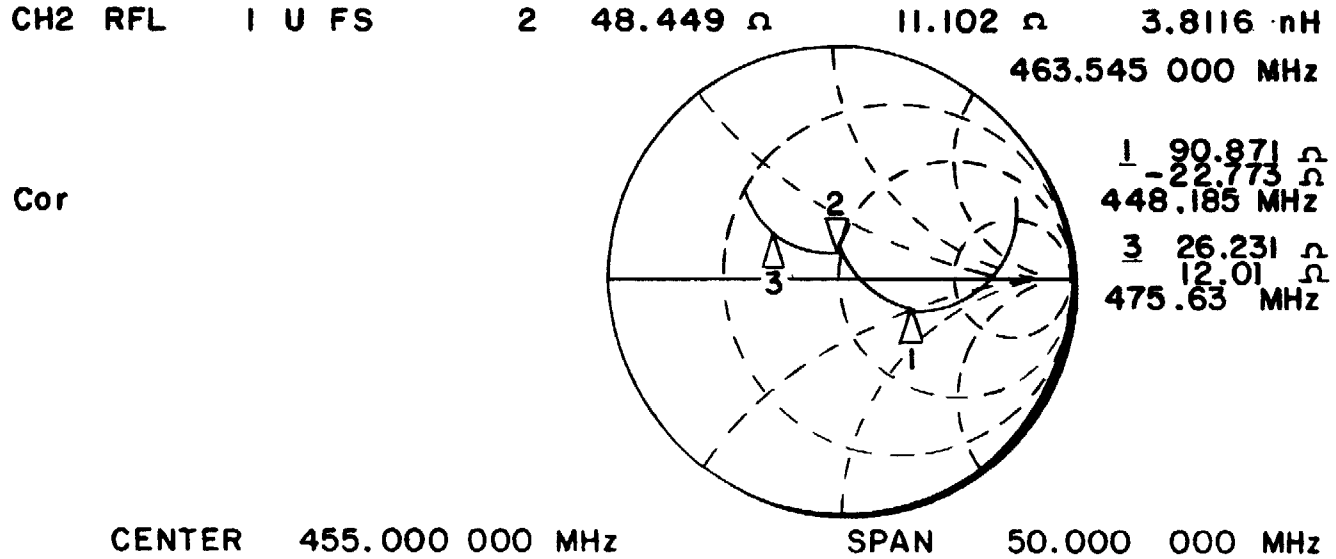
FIG. 6B shows a Smith Chart plot of the antenna response shown in FIG. 6A.
Figures 7A, 7B:
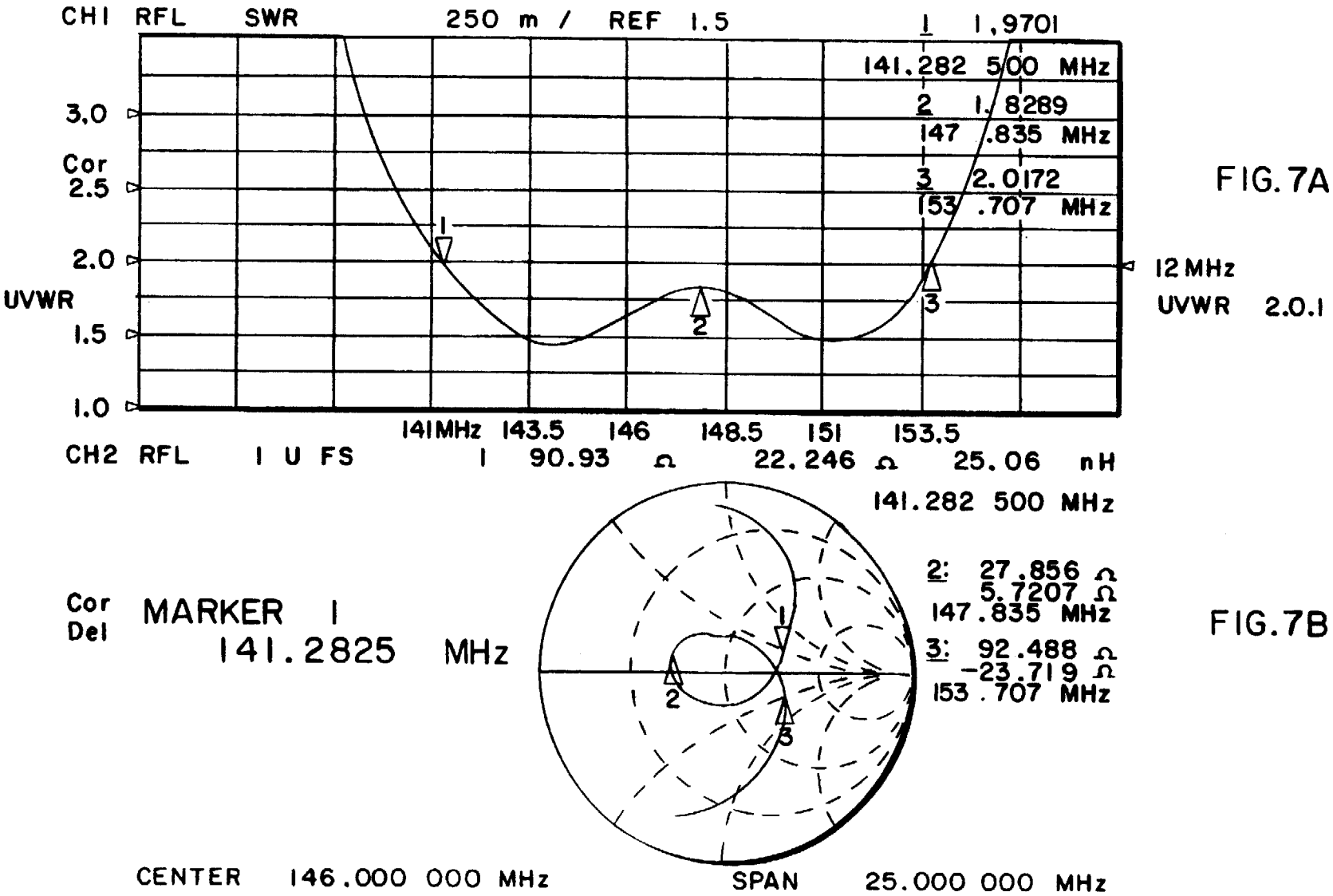
FIG. 7A shows a frequency response graph of an antenna constructed according to the present invention centered at approximately 141 MHz.
FIG. 7B shows a Smith Chart plot of the curve for the antenna of FIG. 7A.
Figure 8A:
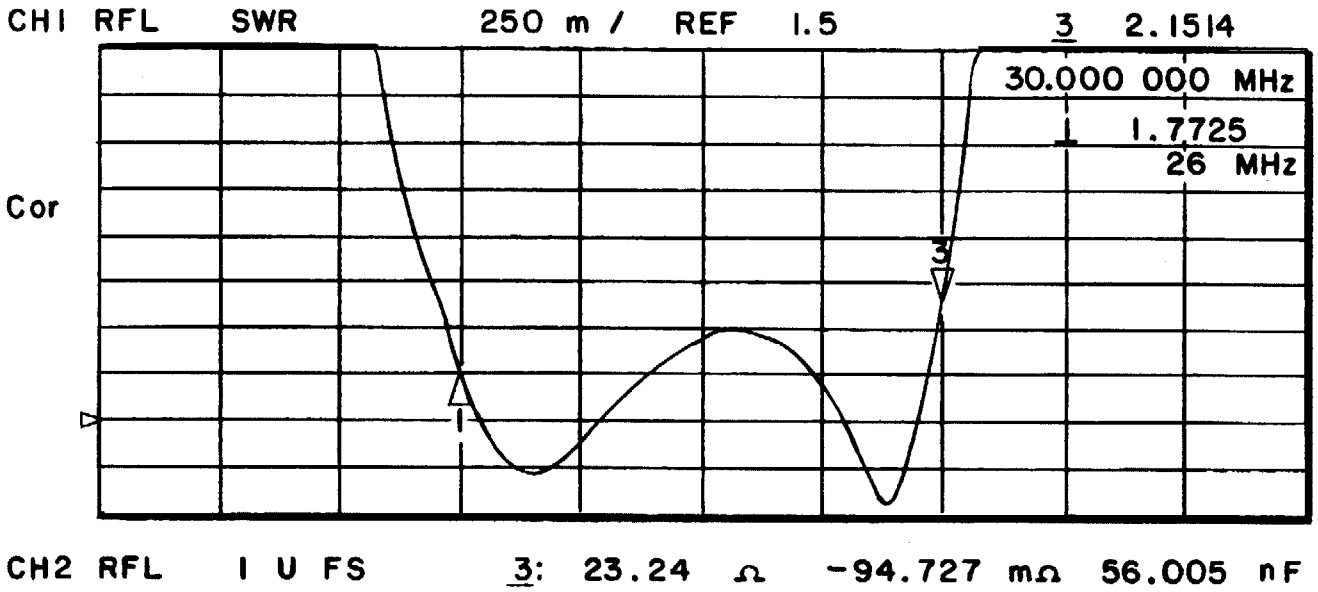
FIG. 8A shows a frequency response graph of an antenna constructed according to the present invention centered at approximately 28 MHz.
Figure 8B:
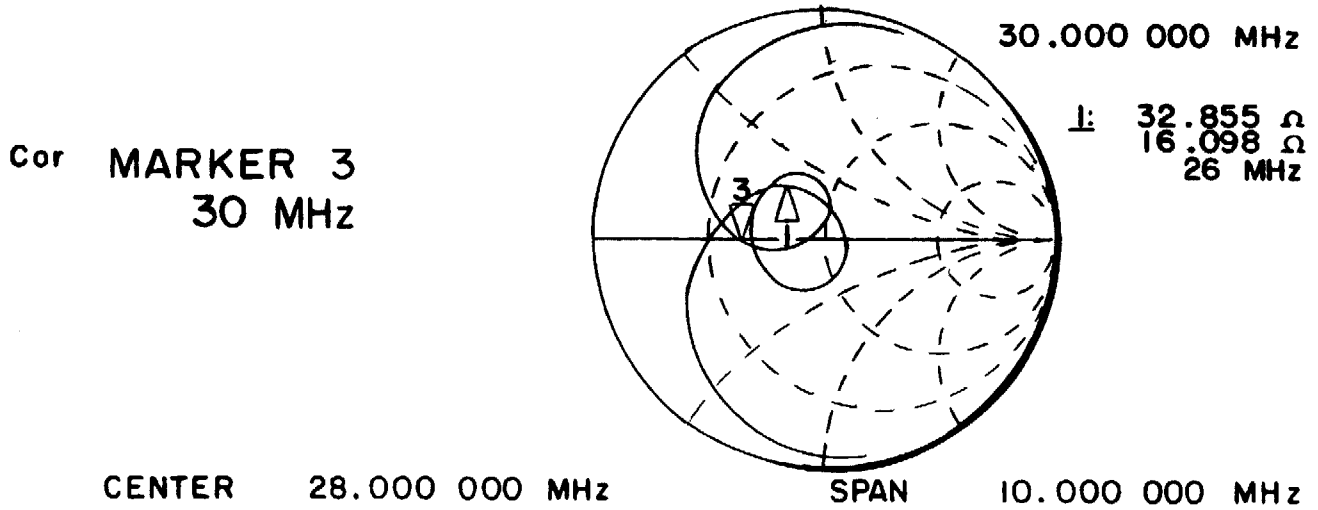
FIG. 8B shows a Smith Chart plot for the antenna response shown in the plot of FIG. 8A.
Figure 9A:
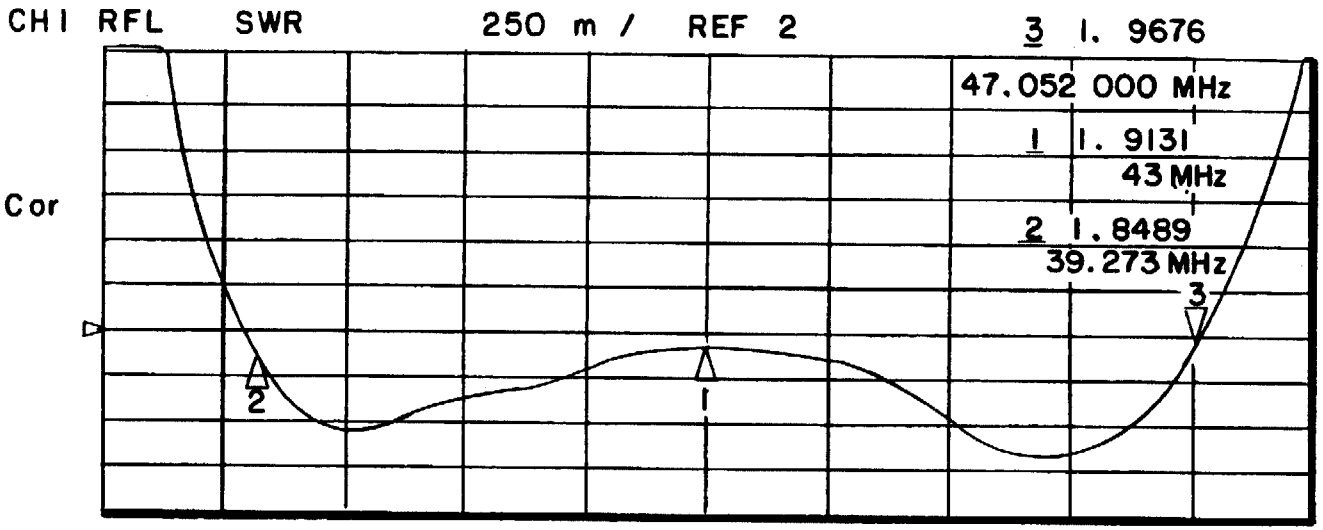
FIG. 9A shows a frequency response graph of an antenna constructed according to the present invention centered at approximately 43 MHz.
Figure 9B:
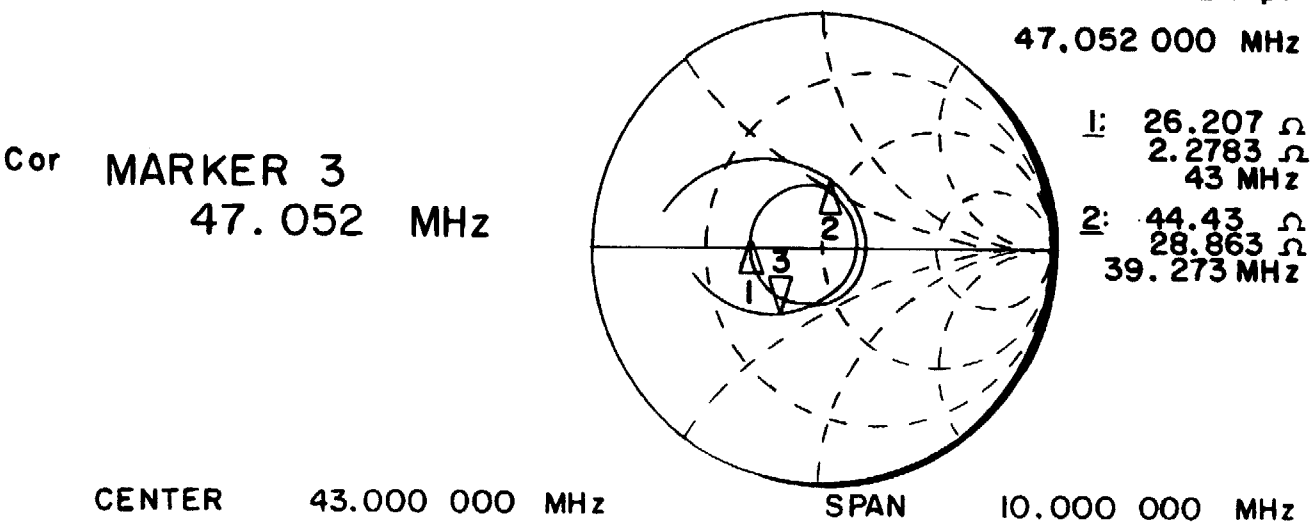
FIG. 9B shows a Smith Chart plot for the antenna frequency response shown in FIG. 9A.

FIG. 5 shows a housing 50 having a top metal shield 52 and a bottom ring 54. The antenna matching 10 and band-broadening compensating 30 networks fit in the housing 50 between the top metal shield 52 and the bottom ring 54. An insulator 56 made of plastic or other material is used to separate the two toroidal inductors. The antenna matching network toroidal inductor 12 is placed adjacent the top metal shield 52 and spaced apart from the series resonant inductor 42 which is held near the bottom of the housing 50 generally adjacent to the bottom ring 54. As shown in FIG. 5, the inductor 34 of the compensating network 30 is contemplated as having two geometries. One geometry is designated as 34*a* and has a coiled geometry including several turns of a wire of appropriate gauge. The capacitor 32 (not shown in FIG. 5) is connected in parallel as a shunt across the transmitting signal lines and in parallel to the series resonant inductor 42.

Alternatively, and for high frequency applications, a band-broadening inductor designated 34*b* takes the shape of a half-loop of conducting tape or the like connected in parallel with the series resonant capacitor 32. For higher frequencies, such as those over 50 MHz, the wide conducting tape 34*b* provides the proper inductance to create the appropriate parallel resonance network. When such high frequencies over 50 MHz are used, the optional series resonant network 38 of band-broadening compensating network 30 is generally omitted to enhance performance characteristics.

By choosing the appropriate capacitances and inductances, a wide-banded mobile antenna may be realized. The Smith Charts of FIGS. 6A–9B show the response of the antennas of the present invention for the indicated circuit regimes. The table below also indicates the shunt and series capacitances as well as the VSWR for certain antennas in certain frequency domains. The frequency range of 36–50 MHz generally corresponds to the charts shown in FIGS. 9A and 9B. The frequency range of 450–512 MHz generally corresponds to the charts shown in FIGS. 6A and 6B.

| FRE-QUENCY | BAND-WIDTH | SHUNT C | SERIES C | VSWR | AN-TENNA |
|---|---|---|---|---|---|
| 26–36 MHz | 4 MHz | 780 pf | 22 pf | 1.8:1 | <¼wave |
| 36–50 MHz | 8 MHz | 460 pf | 22 pf | 1.8:1 | <¼wave |
| 132–174 MHz | 12 MHz | 150 pf | None | 1.8:1 | ½–⅝wave |
| 144–162 MHz | 18 MHz | 100 pf | None | 1.8:1 | ½–⅝wave |
| 450–512 MHz | 25 MHz | 75 pf | None | 1.8:1 | ⅝collinear |

Resonating inductances may be calculated according to U.S. Pat. No. 4,835,539 issued to Paschen on May 30, 1989 and incorporated herein by this reference thereto. The references made to the works by Matthaei et al. mentioned in the Paschen patent and above may also be used to calculate elements of the compensating network. The Matthaei et al. works are incorporated herein by this reference, but generally prove tedious and time consuming for continual reference use. An alternative means by which the circuit elements for the compensating network may be calculated is briefly described below.

By measuring the frequency response of the matched antenna, the Q of the matched antenna can be found, or calculated, by calculating the equivalent RCL series inductance and capacitance of the matched antenna with its matching network. Knowing the VSWR versus frequency relationship for the matched antenna allows a determination of the matched antenna's reactance and its reactive components, especially through the known and available calculation of the reflection coefficient at a chosen VSWR at band edges. From the matched antenna's inductance and capacitance, a mathematical model of the matched antenna can be constructed for use in modelling the compensation network as the Q of the matched antenna provides enough foundation to construct an appropriate compensating network.

As the preferred VSWR is 1.8:1, the bandwidth of the ultimate matched antenna with compensating network is chosen as being double that of the bandwidth of the matched antenna alone at VSWR of 1.8:1. According to Wheeler in his March 1983 paper, above, this is the maximum available bandwidth expansion, although the constructed antenna, with its added losses, may have a slightly larger than double bandwidth.

With the Q of the matched antenna and the selected bandwidth, the components for the compensating network can then be calculated by known methods disclosed in the Matthaei et al. references and along the lines known for construction of Chebyshev filters. Upon determination of the compensating network components, the compensating network is constructed and connected to the matched antenna. The compensated and matched antenna may then be tuned manually.

Once a prototype compensated and matched antenna is constructed, uniform manufacturing techniques may be used to consistently construct a compensated and matched antenna by automation or hand with uniform parts assembled in a uniform manner.

Known calculating algorithms that run upon a personal computer, such as software marketed under the name of MATHCAD®, may be used to aid in determining the component values not only for the matched antenna, but also those for the compensating network. As mentioned above, known methods such as those in Paschen or Matthaei et al. may be used.

Once the antenna has been modeled mathematically, it must be physically constructed and tuned. The actual construction of the antenna creates unpredictable changes in frequency response, making the tuning procedure of a prototype antenna a manual procedure, approaching an art when optimization is easily and quickly accomplished. However, as set forth above, uniform manufacturing techniques can be used to provide antennas with uniform behavior.

Generally, all antennas undergoing the foregoing process will have a 1.8:1 VSWR. During the tuning process, all antennas have their bandwidth doubled at the given VSWR as this is the generally available limit for bandwidth broadening. The antennas are then frequency swept, and their natural bandwidths are established so that the operating characteristics of the antennas are known and can be used and/or corrected. From the compensating network calculation by equivalent circuit, above, a table of capacitor and inductor values is constructed with the shunt element of the compensating network being a capacitor and the series element being an inductor.

While the compensating network may be tuned to the center frequency of the matched antenna, initially, the compensating network may be tuned instead to an approximate frequency one-half to one percent (½–1%) above the center frequency of the desired bandwidth. This accommodates later tuning procedures for the combined matched antenna with compensating network. Generally, there is a balance between the matched antenna and the compensating network and bringing up the compensating network to tune at a slightly higher frequency reduces the number of overall changes that have to be made to the ultimate matched and compensated antenna. Otherwise, generally, the center tuned frequency of the matched antenna needs raising which changes the center tuned frequency of the overall antenna.

Likewise, the antenna with its matching network may be initially tuned to an approximate frequency one-half to one percent (½–1%) above the center frequency of the desired bandwidth. By raising the tuned frequency of either the combined antenna network (antenna with matching network) or the compensating network, later fine tuning of the ultimate finished antenna is more easily accomplished.

The networks are then constructed with the calculated capacitor and inductor values. The constructed networks are then evaluated with adjustment occurring to ensure proper operating characteristics of the network. The antenna with its matching network is then added to the compensating network, and the two are evaluated as one network circuit. The networks are then adjusted by altering the capacitance and inductance as necessary. When the antenna has been optimized, it is ready for use and shipment.

While the present invention has been described with regards to particular embodiments, it is recognized that additional variations of the present invention may be devised without departing from the inventive concept.

What I claim is:

1. A mobile antenna having broadbanding characteristics, comprising:

a housing, said housing removably attachable to a connector, said housing defining an internal cavity;

an antenna, said antenna coupled to said housing;

an antenna matching network, said antenna matching network coupled to said antenna and matching an impedance of said antenna with an impedance of an incoming transmission line coupled to said antenna, said matching network in combination with said antenna and any associated ground plane comprising a combined antenna network, said combined antenna network tuned so that an impedance of said combined antenna network has a real portion between approximately twenty-five and thirty-five ohms (25–35 Ω) over an intended bandwidth of said antenna and has a reactance portion of approximately zero (0) for a frequency range extending from approximately a center frequency of said intended bandwidth to approximately one to two megahertz (1–2 MHz) higher than that of said approximate center frequency of said intended bandwidth of said antenna; and an antenna compensating network, said antenna compensating network coupled to said antenna and broadening an initial bandwidth of said antenna, said antenna compensating network tuned approximately to said approximate center frequency of said intended bandwidth of said antenna; whereby said antenna matching network and said antenna compensating network are situated within said internal cavity of said housing and are protected by said housing.

2. The mobile antenna of claim 1, further comprising:

said antenna compensating network initially tuned to a frequency approximately one-half to one percent (½–1%) above said approximate center frequency of said intended bandwidth.

3. The mobile antenna of claim 1, further comprising:

said combined antenna network initially tuned to a frequency approximately one-half to one percent (½–1%) above said approximate center frequency of said intended bandwidth.

4. The mobile antenna of claim 1, further comprising:

said connector being of standard design allowing the mobile antenna to be interchangeable with existing mobile antennas.

5. The mobile antenna of claim 1, wherein said antenna matching network further comprises:

a metal shield, said metal shield forming a portion of said housing; and a matching network inductor, said matching network inductor connected in series with said antenna, said matching network inductor located adjacent said metal shield; whereby said metal shield shielding said matching network inductor from fields generated by said antenna and said metal shield creating a parasitic capacitance between said metal shield and said matching network inductor, said parasitic capacitance connected in parallel with said antenna and forming a portion of said antenna matching network.

6. The mobile antenna of claim 5, wherein said matching network inductor further comprises:

a first coil wound upon a first toroid core; and said matching network inductor generating a field generally parallel to said fields generated by said antenna.

7. The mobile antenna of claim 1, wherein said antenna compensating network further comprises:

a parallel resonance network, said parallel resonance network connected in parallel with said antenna.

8. The mobile antenna of claim 7, wherein said parallel resonance network further comprises:

a parallel resonance capacitor connected in parallel with said antenna; and a parallel resonance inductor connected in parallel with said antenna and said parallel resonance capacitor.

9. The mobile antenna of claim 8, wherein said parallel resonance inductor further comprises:

a parallel resonance inductor generating fields generally perpendicular to fields of said antenna and said antenna compensating network; whereby said fields generated by said parallel resonance inductor generally do not couple with said fields of said antenna compensating network and said fields of said antenna compensating network generally do not couple with said fields of said parallel resonance inductor.

10. The mobile antenna of claim 9, wherein said parallel resonance inductor further comprises:

a conducting coil having at least one turn.

11. The mobile antenna of claim 9, wherein said parallel resonance inductor further comprises:

a conducting coil having less than one turn.

12. The mobile antenna of claim 11, wherein said conducting coil further comprises:

a strip of conducting tape.

13. The mobile antenna of claim 7, wherein said antenna compensating network further comprises:

a series resonance network connected in series with said antenna.

14. The mobile antenna of claim 13, wherein said series resonance network further comprises:

a series resonance capacitor connected in series with said antenna; and a series resonance inductor connected in series with said antenna and said series resonance capacitor.

15. The mobile antenna of claim 14, wherein said series resonance inductor, further comprises:

a second coil wound upon a second toroid core; and said series resonance inductor generating a field generally parallel to fields generated by said antenna.

16. The mobile antenna of claim 1, wherein said antenna is selected from the group consisting of antennas of length less than one-quarter wavelength (¼ λ), antennas of length between one-half and five-eighths wavelength (½–⅝ λ), and antennas collinearly equivalent thereof.

17. A mobile antenna having broadbanding characteristics, comprising:

a housing, said housing removably attachable to a connector, said housing defining an internal cavity and said connector being of standard design allowing the mobile antenna to be interchangeable with existing mobile antennas;

an antenna, said antenna coupled to said housing, said antenna selected from the group consisting of antennas of length less than one-quarter wavelength (¼ λ), antennas of length between one-half and five-eighths wavelength (½–⅝ λ), and antennas collinearly equivalent thereof;

an antenna matching network, said antenna matching network coupled to said antenna and matching an impedance of said antenna with an impedance of an incoming transmission line coupled to said antenna, said matching network in combination with said antenna and any associated ground plane comprising a combined antenna network, said combined antenna network tuned so that an impedance of said combined antenna network has a real portion between approximately twenty-five and thirty-five ohms (25–35 Ω) over an intended bandwidth of said antenna, said combined antenna network impedance having a reactance portion of approximately zero (0) for a frequency range extending from approximately a center frequency of said intended bandwidth to approximately one to two megahertz (1–2 MHz) higher than that of said approximate center frequency of said intended bandwidth of said antenna, said antenna matching network comprising:

a metal shield, said metal shield forming a portion of said housing; and a matching network inductor, said matching network inductor connected in series with said antenna, said matching network inductor located adjacent said metal shield, said matching network inductor comprising:

a first coil wound upon a first toroid core; and said matching network inductor generating a field generally parallel to fields generated by said antenna; whereby said metal shield shielding said matching network inductor from fields generated by said antenna and said metal shield creating a parasitic capacitance between said metal shield and said matching network inductor, said parasitic capacitance connected in parallel with said antenna and forming a portion of said antenna matching network; and an antenna compensating network, said antenna compensating network coupled to said combined antenna network and broadening an initial bandwidth of said antenna, said antenna compensating network tuned to a frequency approximately one-half to one percent (½–1%) above said approximate center frequency of said intended bandwidth of said antenna, said antenna compensating network comprising:

a parallel resonance network, said parallel resonance network connected in parallel with said antenna and having a parallel resonance capacitor connected in parallel with said antenna and a parallel resonance inductor connected in parallel with said antenna and said parallel resonance capacitor, said parallel resonance inductor generating fields generally perpendicular to fields of said antenna and said antenna compensating network; whereby said fields generated by said parallel resonance inductor generally do not couple with said fields of said antenna compensating network and said fields of said antenna compensating network generally do not couple with said fields of said parallel resonance inductor; whereby said antenna matching network and said antenna compensating network are situated within said internal cavity of said housing and are protected by said housing.

18. The mobile antenna of claim 17, wherein said parallel resonance inductor further comprises:

a conducting coil having at least one turn.

19. The mobile antenna of claim 17, wherein said parallel resonance inductor further comprises:

a conducting coil having less than one turn.

20. The mobile antenna of claim 19, wherein said conducting coil further comprises:

a strip of conducting tape.

21. The mobile antenna of claim 17, wherein said antenna matching network further comprises:

a series resonance network connected in series with said antenna.

22. The mobile antenna of claim 21, wherein said series resonance network further comprises:

a series resonance capacitor connected in series with said antenna; and a series resonance inductor connected in series with said antenna and said series resonance capacitor.

23. The mobile antenna of claim 22, wherein said series resonance inductor, further comprises:

a second coil wound upon a second toroid core; and said series resonance inductor generating a field generally parallel to fields generated by said antenna; whereby said fields generated by said parallel resonance inductor generally do not couple with said fields of said series resonance inductor and said fields of said series resonance inductor generally do not couple with said fields of said parallel resonance inductor.

24. A mobile antenna having broadbanding characteristics, comprising:

a housing, said housing removably attachable to a connector, said housing defining an internal cavity and said connector being of standard design allowing the mobile antenna to be interchangeable with existing mobile antennas;

an antenna, said antenna coupled to said housing, said antenna selected from the group consisting of antennas of length less than one-quarter wavelength (¼ λ), antennas of length between one-half and five-eighths wavelength (½–⅝ λ), and antennas collinearly equivalent thereof;

an antenna matching network, said antenna matching network coupled to said antenna and matching an impedance of said antenna with an impedance of an incoming transmission line coupled to said antenna, said antenna matching network in combination with said antenna and any associated ground comprising a combined antenna network, said combined antenna network tuned so that an impedance of said combined antenna network has a real portion between approximately twenty-five and thirty-five ohms (25–35 Ω) over an intended bandwidth of said antenna, said combined antenna network impedance having a reactance portion of approximately zero (0) for a frequency range extending from approximately a center frequency of said intended bandwidth to approximately one to two megahertz (1–2 MHz) higher than that of said approximate center frequency of said intended bandwidth of said antenna, said combined antenna network initially tuned to a frequency approximately one-half to one percent (½–1%) above said approximate center frequency of said intended bandwidth, said antenna matching network comprising:

a metal shield, said metal shield forming a portion of said housing; and a matching network inductor, said matching network inductor connected in series with said antenna, said matching network inductor located adjacent said metal shield, said matching network inductor comprising:

a first coil wound upon a first toroid core; and said matching network inductor generating a field generally parallel to fields generated by said antenna; whereby said metal shield shielding said matching network inductor from fields generated by said antenna and said metal shield creating a parasitic capacitance between said metal shield and said matching network inductor, said parasitic capacitance connected in parallel with said antenna and forming a portion of said antenna matching network; and an antenna compensating network, said antenna compensating network coupled to said combined antenna network and broadening an initial bandwidth of said antenna, said antenna compensating network tuned approximately to said approximate center frequency of said intended bandwidth of said antenna, said antenna compensating network comprising:

a parallel resonance network, said parallel resonance network connected in parallel with said antenna and having a parallel resonance capacitor connected in parallel with said antenna and a parallel resonance inductor connected in parallel with said antenna and said parallel resonance capacitor, said parallel resonance inductor generating fields generally perpendicular to fields of said antenna and said antenna compensating network; whereby said fields generated by said parallel resonance inductor generally do not couple with said fields of said antenna compensating network and said fields of said antenna compensating network generally do not couple with said fields of said parallel resonance inductor; whereby said antenna matching network and said antenna compensating network are situated within said internal cavity of said housing and are protected by said housing.

25. The mobile antenna of claim 24, wherein said parallel resonance inductor further comprises:

a conducting coil having at least one turn.

26. The mobile antenna of claim 24, wherein said parallel resonance inductor further comprises:

a conducting coil having less than one turn.

27. The mobile antenna of claim 26, wherein said conducting coil further comprises:

a strip of conducting tape.

28. The mobile antenna of claim 24, wherein said antenna matching network further comprises:

a series resonance network connected in series with said antenna.

29. The mobile antenna of claim 28, wherein said series resonance network further comprises:

a series resonance capacitor connected in series with said antenna; and a series resonance inductor connected in series with said antenna and said series resonance capacitor.

30. The mobile antenna of claim 29, wherein said series resonance inductor, further comprises:

a second coil wound upon a second toroid core; and said series resonance inductor generating a field generally parallel to fields generated by said antenna; whereby said fields generated by said parallel resonance inductor generally do not couple with said fields of said series resonance inductor and said fields of said series resonance inductor generally do not couple with said fields of said parallel resonance inductor.

31. A mobile antenna having broadbanding characteristics, comprising:

housing means for providing a housing, said housing means removably attachable to a connector and defining an internal cavity therein;

an antenna coupled to said housing;

antenna matching network means coupled to said antenna for matching an impedance of said antenna with an impedance of an incoming transmission line coupled to said antenna, said matching network means in combination with said antenna and any associated ground plane comprising a combined antenna network, said combined antenna network tuned so that an impedance of said combined antenna network has a real portion having a low resistance over an intended bandwidth of said antenna and a very low reactance portion for a substantial bandwidth approximately centered upon an approximate center frequency of said intended bandwidth; and an antenna compensating network means coupled to said antenna for broadening an initial bandwidth of said antenna, said antenna compensating network means tuned approximately to said approximate center frequency of said intended bandwidth of said antenna; whereby said antenna matching network means and said antenna compensating network means are situated within said internal cavity of said housing means and are protected by said housing means.

* * * * *